US012232667B1

(12) United States Patent
Lian

(10) Patent No.: US 12,232,667 B1
(45) Date of Patent: Feb. 25, 2025

(54) AUTOMATIC INDUCTION MOUTHWASH DISPENSER

(71) Applicant: Binglian Lian, Zhongshan (CN)

(72) Inventor: Binglian Lian, Zhongshan (CN)

( * ) Notice: Subject to any disclaimer, the term of this patent is extended or adjusted under 35 U.S.C. 154(b) by 0 days.

(21) Appl. No.: 18/735,766

(22) Filed: Jun. 6, 2024

Related U.S. Application Data

(63) Continuation of application No. 18/473,178, filed on Sep. 22, 2023, now Pat. No. 12,035,856.

(51) Int. Cl.
*A47K 5/18* (2006.01)

(52) U.S. Cl.
CPC ..... *A47K 5/18* (2013.01)

(58) Field of Classification Search
CPC ..... A47K 5/18
See application file for complete search history.

(56) References Cited

U.S. PATENT DOCUMENTS

2018/0193121 A1* 7/2018 Zhao ..... A61L 2/10
2020/0046175 A1* 2/2020 Jenkins ..... A61Q 11/00
2023/0309758 A1* 10/2023 Hafiz ..... A47K 5/18
222/129

* cited by examiner

*Primary Examiner* — Jason K Niesz

(57) ABSTRACT

An automatic induction mouthwash dispenser, including a water tank, a main body, a power supply device, and a deflector device. The main body is connected to a control switch and an electric control board; a first inlet pipe is movably assembled inside the water tank; the deflector device is connected to a second inlet pipe and an outlet pipe; a second induction device is arranged inside the main body, and a first induction device is arranged on a side of the main body.

10 Claims, 7 Drawing Sheets

AUTOMATIC INDUCTION MOUTHWASH DISPENSER

CROSS REFERENCE

This application is a Continuation of the U.S. application Ser. No. 18,473,178 filed on Sep. 22, 2023, and entitled "MOUTHWASH DISPENSER CAPABLE OF AUTOMATIC SENSING AND SUPPLY", now pending, the entire disclosures of which are incorporated herein by reference.

TECHNICAL FIELD

The present disclosure relates to the technical field of dispensers, and more specifically to an automatic induction mouthwash dispenser.

BACKGROUND

As consumers pay more and more attention to oral health management, bacteria in the mouth are the main causative factor of many oral diseases, such as dental caries, periodontal disease, gingivitis, periodontitis, etc. To clean the oral cavity and freshen the breath, mouthwash has been widely recognized and used by people.

The use of mouthwash for gargling can clean the mouth to freshen the breath and is one of the effective measures to prevent a variety of oral diseases. To help the user to take mouthwash, mouthwash dispensing equipment is available on the market. However, most of the dispensing equipment are controlled through a button to dispense water, where it is necessary to push the button manually each time the mouthwash is needed to take or load, such that the operation is cumbersome. In addition, the conventional dispensing equipment only has a simple water function and cannot interact with a cup for taking or loading the mouthwash, which is lack of interest. Therefore, the above-mentioned problems are urgently required to be solved for those skilled in the art.

SUMMARY OF THE DISCLOSURE

In order to make up for the above deficiencies, the present disclosure provides an automatic induction mouthwash dispenser, aiming to mitigate the problems in the related art of cumbersome operations, simple functions, inability to interact with water cups, the lack of interesting.

The present disclosure is specifically implemented as followed.

An automatic induction mouthwash dispenser, including a water tank, a main body, a power supply device, and a deflector device; wherein the main body is connected to a control switch and an electric control board; a first inlet pipe is movably assembled inside the water tank; the deflector device is connected to a second inlet pipe and an outlet pipe; a second induction device is arranged inside the main body, and a first induction device is arranged on a side of the main body.

In some embodiments, the water tank and the main body are detachably connected; the water tank is fixedly connected to the main body in condition of the water tank and the main body being assembled; an end of the first inlet pipe is sealingly connected to an end of the second inlet pipe.

In some embodiments, the power supply device and the deflector device are detachably connected inside the main body; an inlet end of the deflector device is sealingly connected to the second inlet pipe, and an outlet end of the deflector device is sealingly connected to an end of the outlet pipe; the other end of the outlet pipe is arranged with a water outlet, and the water outlet is connected to the main body.

In some embodiments, an inner wall of the main body is fixedly connected to the electric control board, and an outer wall of the main body is fixedly connected to the control switch; the electric control board is electrically connected to the power supply device, the control switch, and the deflector device, respectively.

In some embodiments, an inner wall on a side of the main body is fixedly connected to the second induction device; the second induction device includes an induction coil, and the first induction device includes a metal cup to be used in conjunction with the induction coil for mutual induction.

In some embodiments, a vertical distance between a bottom wall of the metal cup and the induction coil is between 1 mm and 6 mm; in response to the metal cup being close to the induction coil, the induction coil generates a current signal.

By virtue of the above technical solution, through the mutual induction between the metal cup and the induction coil, a current signal is generated and fed back to the electric control board, and the electric control board automatically controls the deflector device to automatically dispense water according to the capacity of the metal cup.

In some embodiments, the second induction device further includes a Hall sensor, and the first induction device includes a first cup to be used in conjunction with the Hall sensor; a magnet is arranged in the first cup.

In some embodiments, the deflector device is configured to be opened or closed in accordance with a signal from the Hall sensor.

By virtue of the above technical solution, after the first cup is placed on the water-taking table of main body, through the mutual induction between the magnet in the first cup and the Hall sensor, a current signal is generated and fed back to the electric control board, and the electric control board automatically controls the deflector device to automatically dispense water according to the capacity of the first cup.

In some embodiments, the second induction device further includes an RFID reader, and the first induction device further includes a second cup to be used in conjunction with the RFID reader; a RFID tag is arranged in the second cup.

In some embodiments, the second cup includes a plurality of second cups, with each of the plurality of second cups arranged with the RFID tag; in response to one of the plurality of second cups being moved to below a water outlet, the RFID reader reads the RFID tag corresponding to the one of the plurality of second cups.

By virtue of the above technical solution, after the second cup is placed on the water-taking table of main body, through the mutual induction between the RFID tag inside the second cup and the RFID reader, a corresponding signal is fed back to the electronic control board, and the electronic control board controls the deflector device to automatically dispense water according to the capacity of the second cup.

Beneficial Effects:

When in use, a container arranged with the first induction device is placed on the water-taking table of the main body; through the mutual induction between the first induction device and the second induction device in the main body, the current signal is generated and fed back to the electric control board for processing and analyzing; the electric control board controls the deflector device to quantitatively extract the mouthwash inside the water tank through the first inlet pipe and the second inlet pipe, and dispense water through the outlet pipe to the inside of the container from the outlet, so as to complete the automatic induction and quantitative water extraction. In this way, customized water dispensing is made regarding different users with different requirements on water amount, such that the mouthwash dispenser is more flexible and intelligent, replacing a manual operation to press the button to improve the ease of use and fun. Further, damages to the coil caused by the water entering the bottom of the cup body may be prevented, so as to improve the service life. In addition, the proposed cup has a lower cost and can be customized after loss, so as to improve applicability.

BRIEF DESCRIPTION OF THE DRAWINGS

To illustrate the technical solutions of the embodiments of the present disclosure more clearly, the accompanying drawings to be used in the embodiments will be briefly introduced below. It is to be understood that the following drawings only show some embodiments of the present disclosure, and therefore should not be regarded as a limitation of the scope of the present disclosure, and for those skilled in the art, other relevant drawings can be obtained according to these drawings without creative labor.

Figure 1:
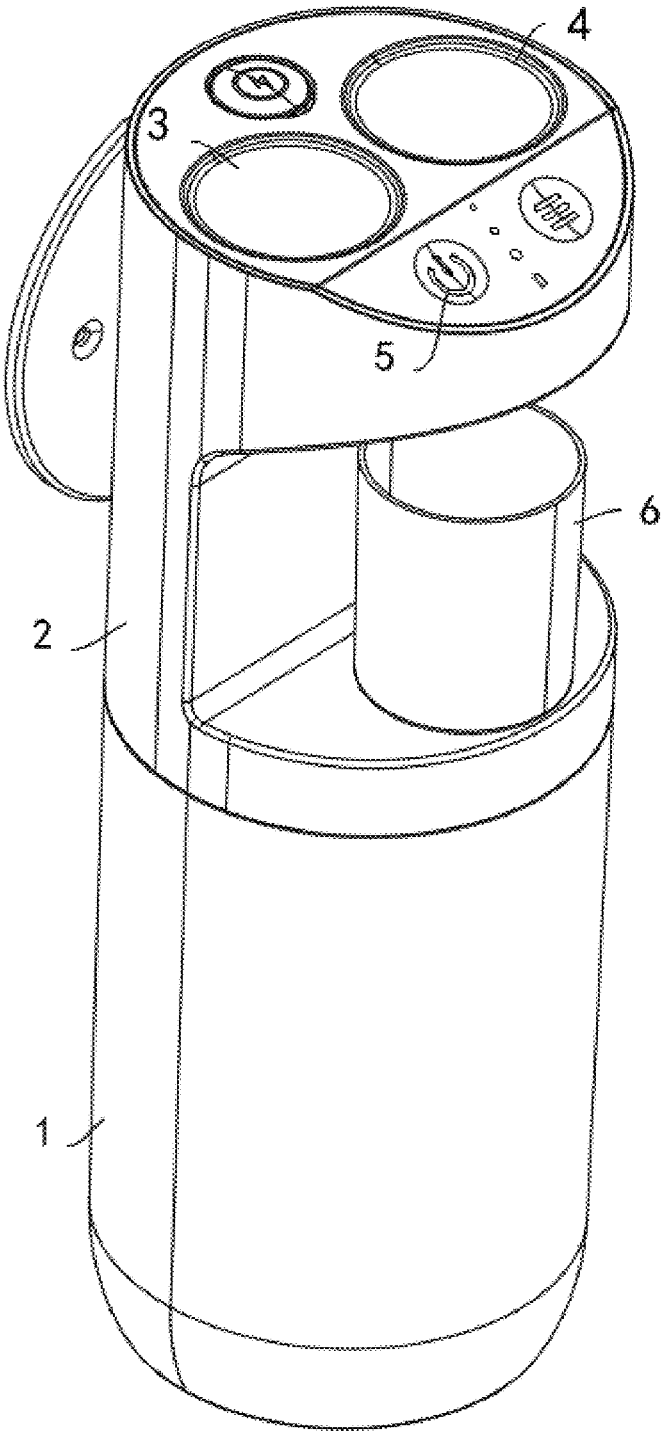
FIG. 1 is a schematic view of an overall structure of an automatic induction mouthwash dispenser according to some embodiments of the present disclosure.

Reference numerals: 1, water tank; 2, main body; 3, first placing platform; 4, second placing platform; 5, control switch; 6, first induction device; 61, metal cup; 62, first cup; 621, magnet; 63, second cup; 631, RFID tag; 7, first inlet pipe; 8, power supply device; 9, second inlet pipe; 10, electric control board; 11, outlet pipe; 12, water outlet; 13, deflector device; 14, second induction device; 141, induction coil; 142, Hall sensor; 143, RFID reader.

DETAILED DESCRIPTION

In order to make the purpose, technical solutions and advantages of the embodiments of the present disclosure clearer, the technical solutions in the embodiments of the present disclosure will be described clearly and completely in the following in conjunction with the accompanying drawings in the embodiments of the present disclosure, and it is obvious that the described embodiments are part of the embodiments of the present disclosure, not all of the embodiments. Based on the embodiments in the present disclosure, all other embodiments obtained by those skilled in the art without making creative labor fall within the scope of the present disclosure.

Embodiment 1

Referring to FIGS. 1-FIG. 7, an automatic induction mouthwash dispenser including a water tank 1, a main body 2, a power supply device 8, and a deflector device 13; where the main body 2 is connected to a control switch 5 and an electric control board 10; a first inlet pipe 7 is movably assembled inside the water tank 1; the deflector device 13 is connected to a second inlet pipe 9 and an outlet pipe 11; a second induction device 14 is arranged inside the main body 2, and a first induction device 6 is arranged on a side of the main body 2.

Further, the water tank 1 and the main body 2 are detachably connected; the water tank 1 is fixedly connected to the main body 2 when the water tank 1 and the main body 2 are assembled; an end of the first inlet pipe 7 is sealingly connected to an end of the second inlet pipe 9; the power supply device 8 and the deflector device 13 are detachably connected inside the main body 2; an inlet end of the deflector device 13 is sealingly connected to the second inlet pipe 9, and an outlet end of the deflector device 13 is sealingly connected to an end of the outlet pipe 11; the other end of the outlet pipe 11 is arranged with a water outlet 12, and the water outlet 12 is connected to the main body 2.

It should be noted that by virtue of the detachable connection between the water tank 1 and the main body 2, the main body 2 can be disassembled after the mouthwash inside the water tank 1 is used up, to facilitate the replacement of a new water tank 1 for use. In addition, an end of the first inlet pipe 7 far from the second inlet pipe 9 is movably inserted into the water tank 1 to extract the mouthwash. In addition, the power supply device 8 may be adopted with a dry cell battery or a rechargeable battery to energize components inside the main body 2, and a cover can be opened to facilitate the replacement of the power supply device 8, to better disassemble, replace, and maintain corresponding components through the detachable connection of the various components. An upper end of the main body 2 may be arranged with a first placing platform 3 and a second placing platform 4 for placing containers; and/or, the containers may be placed on a placing rack, which is to be used in conjunction with the main body; and/or the containers may be placed on a carrying platform, on a side of the main body, with a placing effect.

Figure 2:
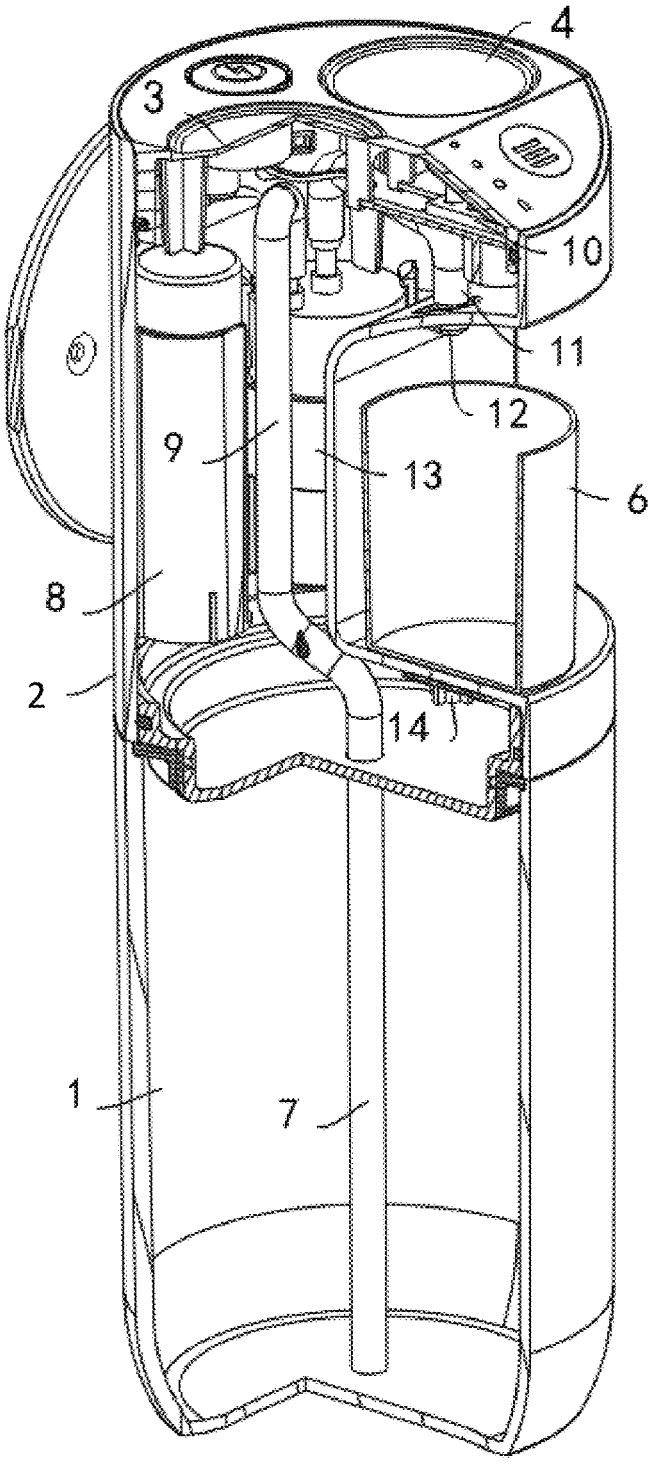
FIG. 2 is a schematic view of an inner overall structure of an automatic induction mouthwash dispenser according to some embodiments of the present disclosure.
Figure 3:
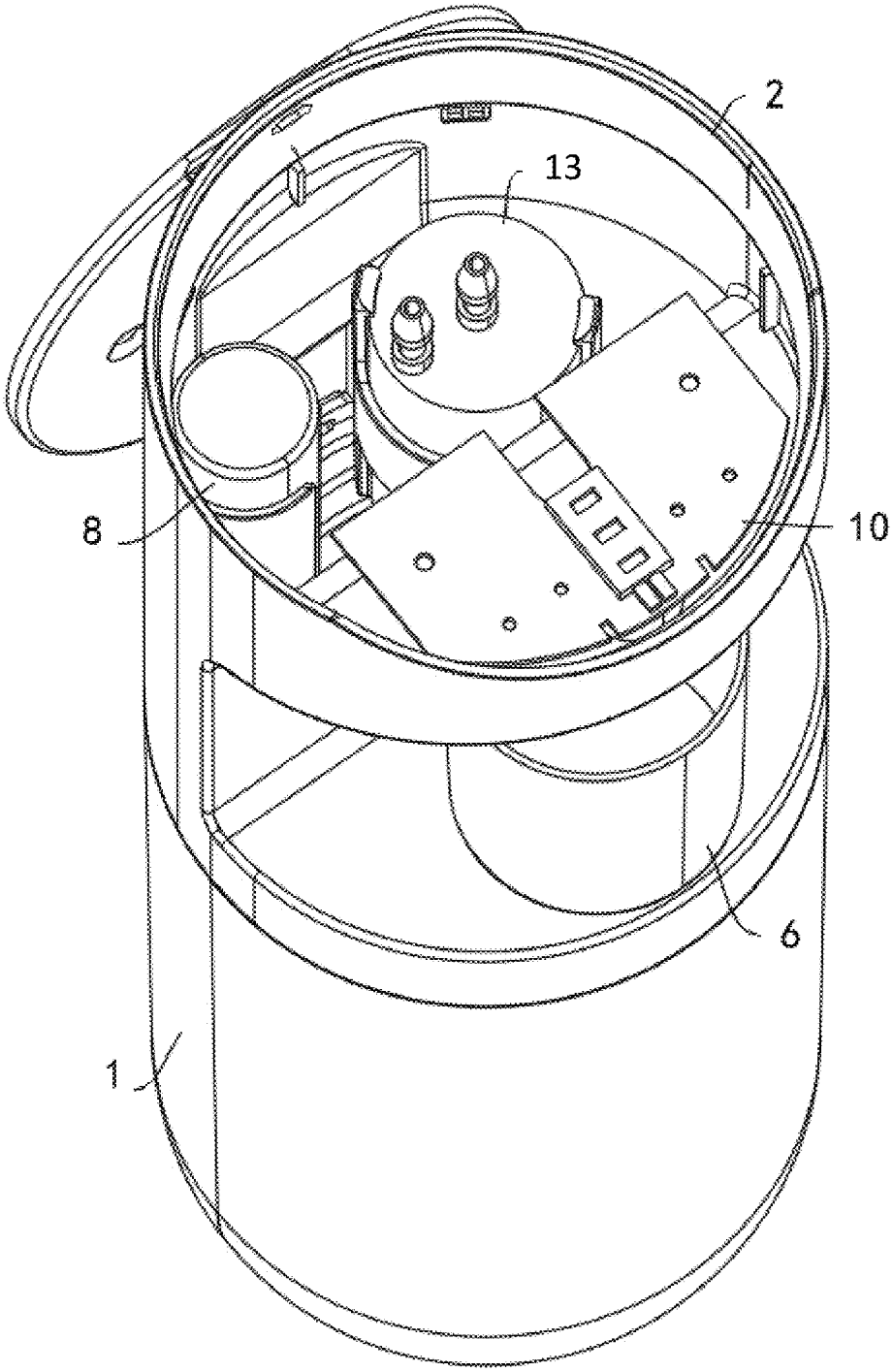
FIG. 3 is a schematic view of an inner structure of a main body of an automatic induction mouthwash dispenser according to some embodiments of the present disclosure.
Figure 4:
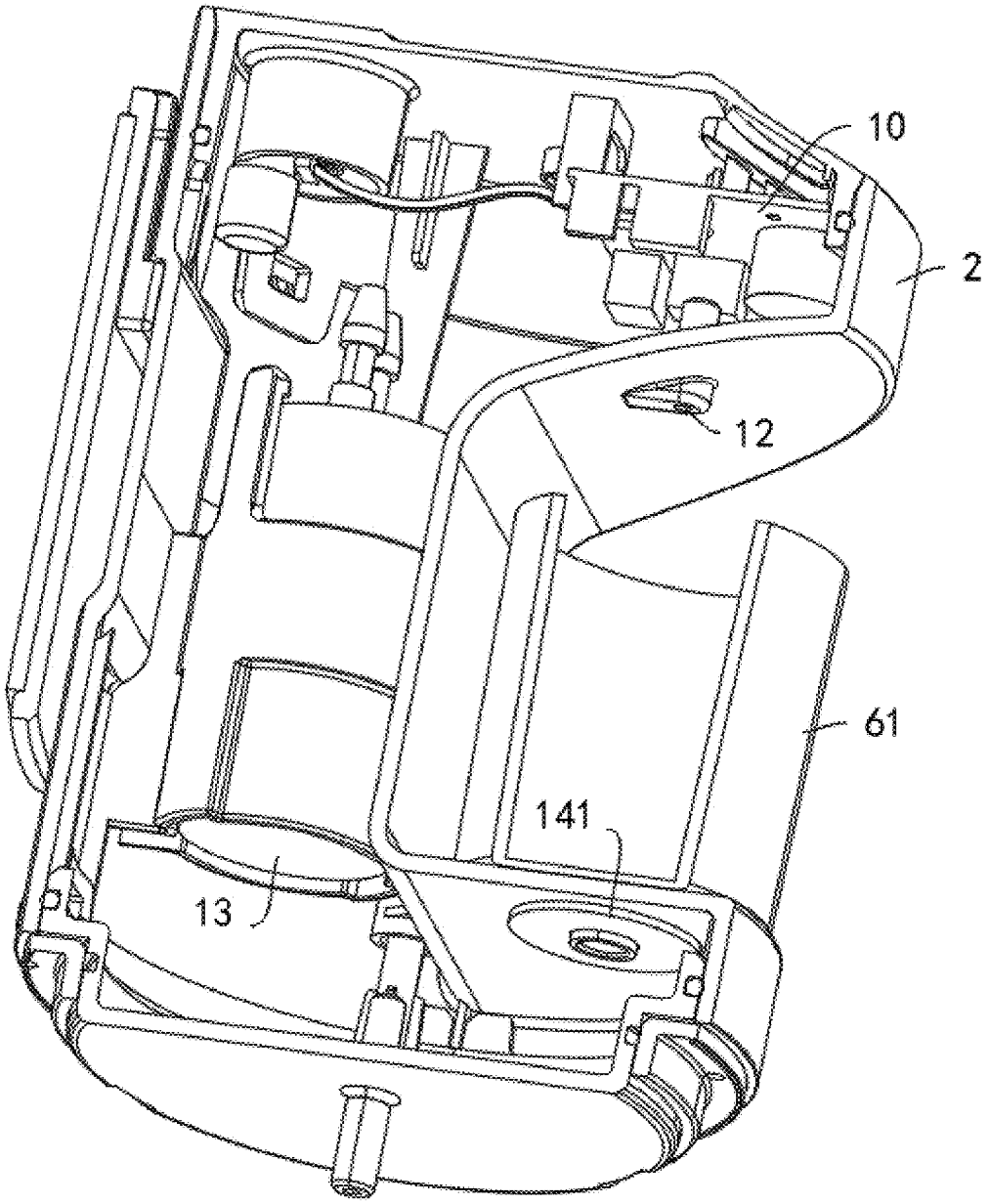
FIG. 4 is a structural schematic view of an automatic induction mouthwash dispenser according to Scheme 1 of the present disclosure.

Referring to FIGS. 2-FIG. 4, an inner wall of the main body 2 is fixedly connected to the electric control board 10, and an outer wall of the main body 2 is fixedly connected to the control switch 5; the electric control board 10 is electrically connected to the power supply device 8, the control switch 5, and the deflector device 13, respectively; the inner wall on a side of the main body 2 is fixedly connected to the second induction device 14; the second induction device 14 includes an induction coil 141, and the first induction device 6 includes a metal cup 61 to be used in conjunction with the induction coil 141 for mutual induction; a vertical distance between a bottom wall of the metal cup 61 and the induction coil 141 is set between 1 mm and 6 mm; in response to the metal cup 61 being close to the induction coil 141, the induction coil 141 generates a current signal.

It is to be noted that: the electric control board 10 is electrically connected to the second induction device 14. When water taking is carried out, the metal cup 61 (which may be a water cup with a metal part) may be placed on a water-taking table of the main body 2, and through the mutual induction between the metal part of the metal cup 61 and the induction coil 141, the current signal is generated and fed back to the electric control board 10, and the electric control board 10 automatically controls the deflector device 13 to automatically dispense water according to the capacity of the metal cup 61. After the water taking is completed, the cup may be placed on the first placing platform 3 or the second placing platform 4 on the top of the main body, in which case the machine is in standby, waiting for a next-time water taking to repeat the above operations. The metal cup 61 is adopted with a one-piece design, abandoning the traditional assembly design of the cup, thereby effectively preventing the split of the cup body and thus preventing damages to the coil caused by the water entering the bottom of the cup body, so as to improve the service life. In addition, the proposed cup has a lower cost and can be customized after loss, so as to improve applicability.

Embodiment 2

Figure 5:
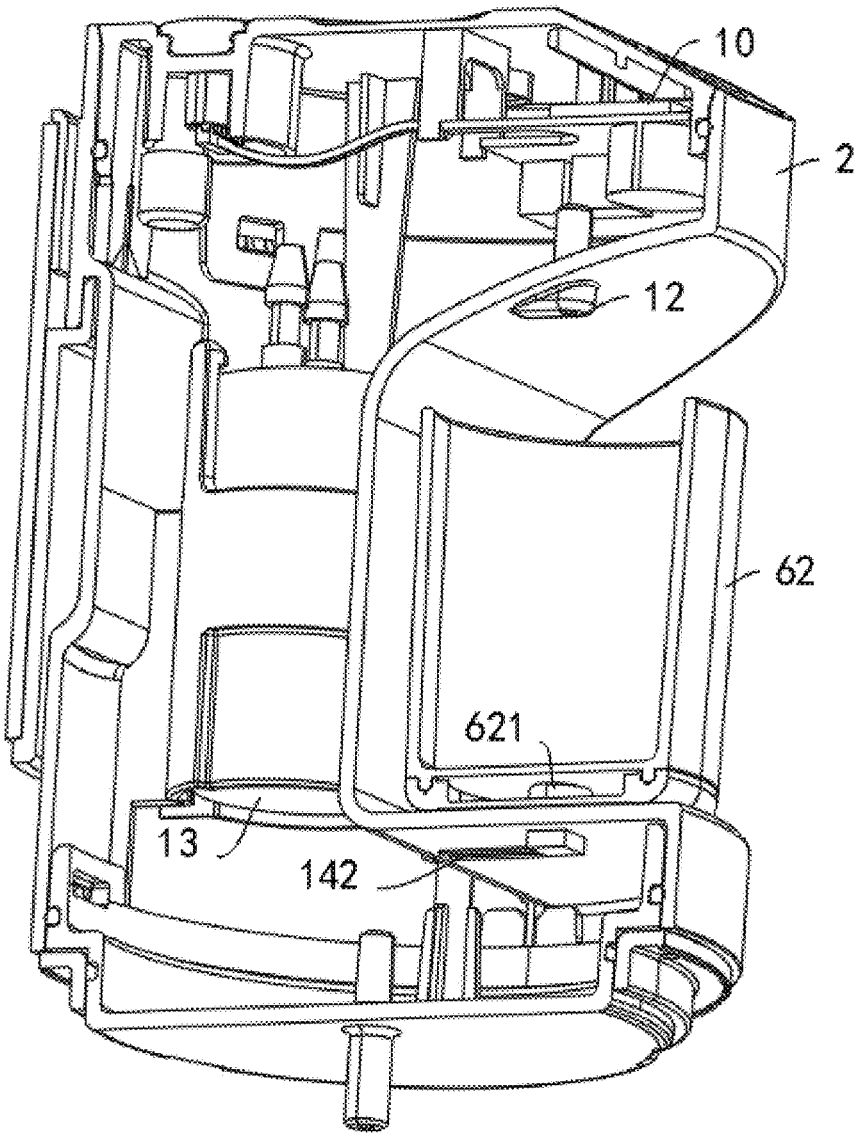
FIG. 5 is a structural schematic view of an automatic induction mouthwash dispenser according to Scheme 2 of the present disclosure.

Referring to FIG. 5, on the basis of Embodiment 1 and different from Embodiment 1, the second induction device 14 further includes a Hall sensor 142, and the first induction device 6 includes a first cup 62 to be used in conjunction with the Hall sensor 142; a magnet 621 is arranged in the first cup 62; the deflector device 13 is configured to be opened or closed in accordance with a signal from the Hall sensor 142.

It should be noted that the first cup 62 may be placed on the water-taking table of main body 2, and through the mutual induction between the magnet 621 in the first cup 62 and the Hall sensor 142, the current signal is generated and fed back to the electric control board 10, and the electric control board 10 automatically controls the deflector device 13 to automatically dispense water. After the water taking is completed, the cup may be placed on the first placing platform 3 or the second placing platform 4 on the top of the main body, in which case the machine is in standby, waiting for a next-time water taking to repeat the above operations.

Embodiment 3

Figure 6:
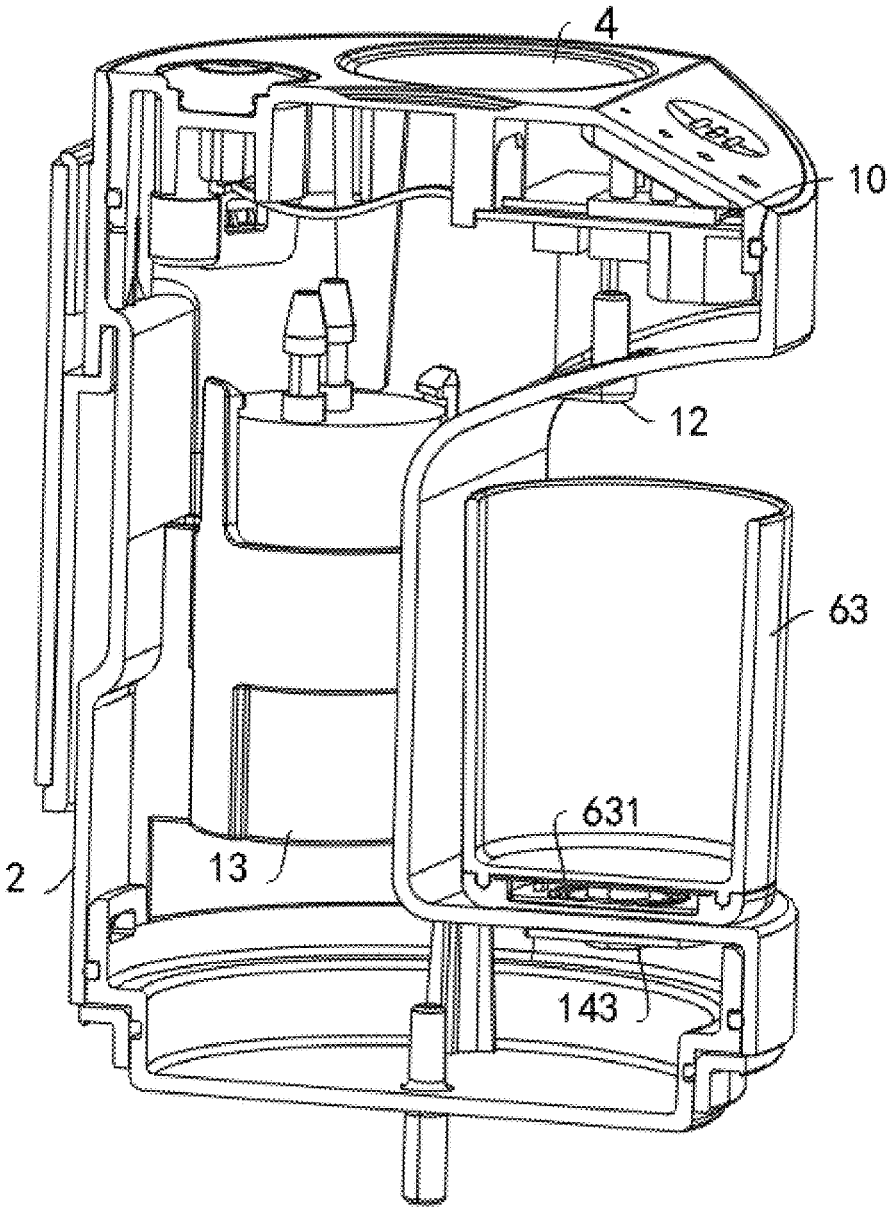
FIG. 6 is a structural schematic view of an automatic induction mouthwash dispenser according to Scheme 3 of the present disclosure.
Figure 7:
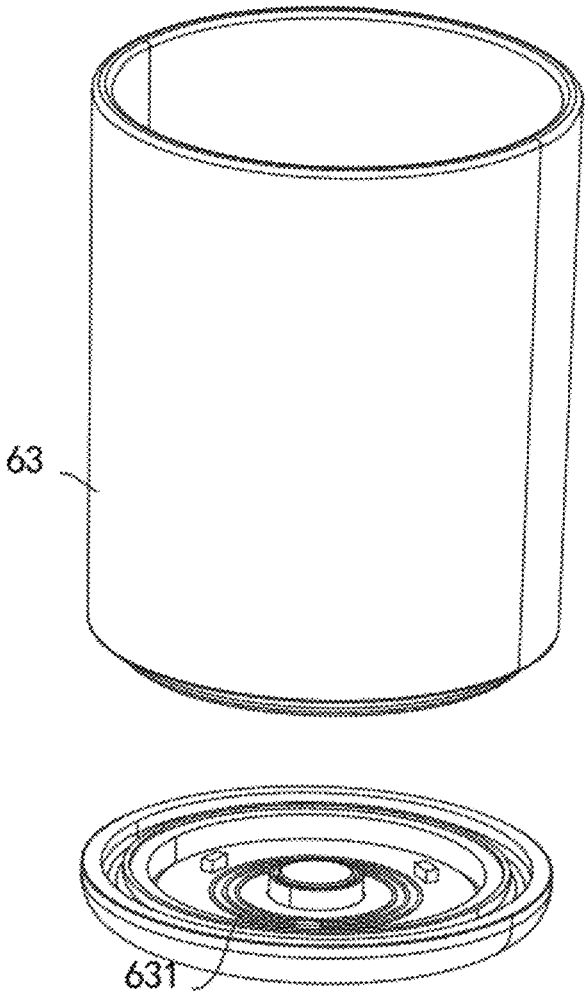
FIG. 7 is a structural schematic view of a cup according to Scheme 3 of the present disclosure.

Referring to FIGS. 6-7, on the basis of Embodiment 1 and different from Embodiment 1 and Embodiment 2, the second induction device 14 further includes an RFID reader 143, and the first induction device 6 further includes a second cup 63 to be used in conjunction with the RFID reader 143; a RFID tag 631 is arranged in the second cup 63; the second cup 63 may be provided in plural, with different second cups 63 arranged with different RFID tags 631. When a certain second cup 63 is moved to below the water outlet 12, the RFID reader 143 can read the corresponding RFID tag 631.

It should be noted that after the second cup 63 is placed on the water-taking table of main body 2, through the mutual induction between the RFID tag 631 inside the second cup 63 and the RFID reader 143, the RFID reader 143 sends a specific-frequency radio frequency signal through a transmitting antenna, and an inductive current will be generated when the RFID tag 631 enters an effective working area of the radio frequency signal such that the RFID tag 631 is energized and activated; the RFID tag 631 transmits its coded information through a built-in antenna; a receiving antenna of the RFID reader 143 receives the modulation signal from the tag, and the modulation signal is transmitted to a signal processing module of the RFID reader 143 through a modulator of the antenna; the modulation signal is demodulated and decoded, such that useful information is transmitted to the electronic control board 10 for processing; the electronic control board 10 controls the deflector device 13 to automatically dispense water according to the capacity of the second cup 63. After the water taking is completed, the cup may be placed on the first placing platform 3 or the second placing platform 4 on the top of the main body, in which case the machine is in standby, waiting for a next-time water taking to repeat the above operations.

A working principle: the control switch 5 is long pressed for two seconds to wake up the device; the size of the water flow is adjusted through the control switch 5, where the first placing platform 3 or the second placing platform 4 are arranged on the top of the main body to facilitate placing containers with different capacity sizes. When in use, a container arranged with the first induction device 6 is placed on the water-taking table of the main body 2; through the mutual induction between the first induction device 6 and the second induction device in the main body 2, the current signal is generated and fed back to the electric control board 10 for processing and analyzing; the electric control board 10 controls the deflector device 13 to quantitatively extract the mouthwash inside the water tank 1 through the first inlet pipe 7 and the second inlet pipe 9, and dispense water through the outlet pipe 11 to the inside of the container from the outlet 12, so as to complete the automatic induction and quantitative water extraction. In this way, customized water dispensing is made regarding different users with different requirements on water amount, such that the mouthwash dispenser is more flexible and intelligent, thereby improving the user experience. In addition, an LED light may be arranged on the bottom of the cup body. Through a combination between on and off of the LED light and start and stop of the mouthwash dispenser, the cup and the mouthwash dispenser interact with each other, adding interest.

It should be noted that the specific model specifications of a motor are required to be determined according to the actual specifications of the device. The specific selection and calculation method thereof is prior art, which is not repeated in detail.

The above is only some embodiments of the present disclosure and is not intended to limit the present disclosure. The present disclosure may have various changes and variations for those skilled in the art, and any modifications, equivalent replacements, improvements, etc. made within the spirit and principles of the present disclosure shall be included in the scope of the present disclosure.

What is claimed is:

1. An automatic induction mouthwash dispenser, comprising a water tank, a main body, a power supply device, a deflector device, and a container; wherein the main body is provided with a control switch and an electric control board; the deflector device is connected to a second inlet pipe and an outlet pipe; the container is provided with a first induction device, and a second induction device is arranged on the main body;

the main body is provided with a water-taking table configured to place the container;

the deflector device is configured to quantitatively extract a mouthwash inside the water tank through a first inlet pipe and the second inlet pipe, and dispense the extracted mouthwash to the container through the outlet pipe.

2. The mouthwash dispenser according to claim 1, wherein the water tank and the main body are detachably connected; the water tank is fixedly connected to the main body in condition of the water tank and the main body being assembled; an end of the first inlet pipe is sealingly connected to an end of the second inlet pipe.

3. The mouthwash dispenser according to claim 1, wherein the power supply device and the deflector device are detachably connected inside the main body; an inlet end of the deflector device is sealingly connected to the second inlet pipe, and an outlet end of the deflector device is sealingly connected to an end of the outlet pipe; an other end of the outlet pipe is arranged with a water outlet, and the water outlet is connected to the main body.

4. The mouthwash dispenser according to claim 1, wherein an inner wall of the main body is fixedly connected to the electric control board, and an outer wall of the main body is fixedly connected to the control switch; the electric control board is electrically connected to the power supply device, the control switch, and the deflector device, respectively.

5. The mouthwash dispenser according to claim 1, wherein an inner wall on a side of the main body is fixedly connected to the second induction device; the second induction device comprises an induction coil, and the container is a metal cup to be used in conjunction with the induction coil for mutual induction.

6. The mouthwash dispenser according to claim 5, wherein the induction coil generates a current signal when a vertical distance between a bottom wall of the metal cup and the induction coil is between 1 mm and 6 mm.

7. The mouthwash dispenser according to claim 1, wherein the second induction device further comprises a Hall sensor, and the container is a cup to be used in conjunction with the Hall sensor; and the first induction device is a magnet arranged in the cup.

8. The mouthwash dispenser according to claim 7, wherein the deflector device is configured to be opened or closed in accordance with a signal from the Hall sensor.

9. The mouthwash dispenser according to claim 1, wherein the second induction device further comprises an RFID reader, and the container is a cup to be used in conjunction with the RFID reader; and the first induction device is a RFID tag arranged in the cup.

10. The mouthwash dispenser according to claim 9, wherein the cup comprises a plurality of cups and the RFID tag comprises a plurality of RFID tags, with each of the plurality of cups arranged with one RFID tag of the plurality of RFID tags; in response to one of the plurality of cups being moved to below a water outlet, the RFID reader reads the RFID tag corresponding to the one of the plurality of cups.

* * * * *